US007963223B2

(12) United States Patent
Schmid et al.

(10) Patent No.: US 7,963,223 B2
(45) Date of Patent: Jun. 21, 2011

(54) APPARATUS AND METHOD FOR BENDING A PRINTING PLATE

(75) Inventors: Georg Schmid, Neusaess (DE); Thomas Kling, Gersthofen (DE); Michael Scholz, Muensterhausen (DE)

(73) Assignee: MAN Roland Druckmashinen AG, Augsburg (DE)

( * ) Notice: Subject to any disclaimer, the term of this patent is extended or adjusted under 35 U.S.C. 154(b) by 280 days.

(21) Appl. No.: 11/524,591

(22) Filed: Sep. 21, 2006

(65) Prior Publication Data

US 2007/0068213 A1 Mar. 29, 2007

(30) Foreign Application Priority Data

Sep. 23, 2005 (DE) ..... 10 2005 045 506

(51) Int. Cl.
*B41C 3/08* (2006.01)

(52) U.S. Cl. ..... 101/401.1; 72/300; 72/308; 72/311

(58) Field of Classification Search ..... 72/300, 72/311, 308; 81/9.3; 101/401, 401.1; 269/166, 269/228

See application file for complete search history.

(56) References Cited

U.S. PATENT DOCUMENTS

| | | | | | |
|---|---|---|---|---|---|
| 3,450,098 | A | * | 6/1969 | Williams, Jr. | 118/126 |
| 3,592,037 | A | * | 7/1971 | Van Cleave | 72/319 |
| 3,682,486 | A | * | 8/1972 | Zwetzig et al. | 360/130.33 |
| 3,914,974 | A | | 10/1975 | DeVore | |
| 3,927,695 | A | * | 12/1975 | Crockwell | 138/137 |
| 4,854,994 | A | * | 8/1989 | Breiter et al. | 156/228 |
| 4,901,963 | A | * | 2/1990 | Yoder | 24/489 |
| 4,939,862 | A | * | 7/1990 | Brandenburg et al. | 42/88 |
| 5,335,046 | A | * | 8/1994 | Bosy | 355/73 |
| 5,402,722 | A | * | 4/1995 | Schneider et al. | 101/415.1 |
| 5,700,357 | A | * | 12/1997 | Didier | 162/358.3 |
| 5,709,150 | A | * | 1/1998 | Durr et al. | 101/415.1 |
| 5,732,629 | A | * | 3/1998 | Puschnerat et al. | 101/415.1 |
| 5,979,214 | A | * | 11/1999 | Fetsch et al. | 72/422 |
| 5,987,949 | A | * | 11/1999 | Palmatier et al. | 72/17.3 |
| 6,159,289 | A | * | 12/2000 | Kurtz et al. | 118/119 |
| 6,543,358 | B1 | * | 4/2003 | Schneider et al. | 101/415.1 |
| 6,561,094 | B1 | * | 5/2003 | Schneider et al. | 101/415.1 |
| 6,598,530 | B1 | * | 7/2003 | Schneider et al. | 101/486 |
| 6,702,768 | B2 | * | 3/2004 | Mano et al. | 601/29 |
| 6,702,928 | B2 | * | 3/2004 | Aho | 162/358.3 |
| 7,303,634 | B2 | * | 12/2007 | Rantanen | 118/325 |
| 7,332,033 | B2 | * | 2/2008 | Henninger et al. | 118/118 |
| 2005/0120899 | A1 | * | 6/2005 | Gelbart et al. | 101/463.1 |
| 2005/0241514 | A1 | * | 11/2005 | Behrens et al. | 101/463.1 |
| 2006/0130667 | A1 | * | 6/2006 | Greve | 99/369 |
| 2007/0033979 | A1 | * | 2/2007 | Deis et al. | 72/307 |

FOREIGN PATENT DOCUMENTS

| | | | |
|---|---|---|---|
| DE | 33 40 144 | C2 | 5/1985 |
| DE | 3340144 | A1 * | 5/1985 |
| DE | 41 28 863 | C1 | 10/1992 |
| DE | 103 38 374 | A1 | 3/2005 |

* cited by examiner

*Primary Examiner* — Ren Yan
*Assistant Examiner* — David Banh
(74) *Attorney, Agent, or Firm* — Crowell & Moring LLP

(57) ABSTRACT

An apparatus and method for bending a printing plate is disclosed. A bending machine, in particular for the bending of printing plates which are used in printing machines, includes a pressure pad, which exerts the required clamping force on the printing plate during the bending operation, and which is movable in relation to a holding-down plate, so that a uniform clamping force acts on the printing plate over the entire length of the pressure pad.

11 Claims, 2 Drawing Sheets

APPARATUS AND METHOD FOR BENDING A PRINTING PLATE

This application claims the priority of German Patent Document No. 10 2005 045 506.9, filed Sep. 23, 2005, the disclosure of which is expressly incorporated by reference herein.

BACKGROUND AND SUMMARY OF THE INVENTION

The present invention relates to a bending machine and method for the bending of metal sheets and, in particular, for the bending of printing plates for use in printing machines.

Bending machines for the bending of metal sheets, but also special machines for the bending of printing plates, which are employed particularly in offset printing, are sufficiently known from the prior art. Thus, for example, it may be gathered from the German patent publication no. DE 33 40 144 C2 that particularly high requirements as to accuracy apply to the bending of the sheet-metal edges of printing plates. This is because the bending edges of the printing plates must be capable of being introduced into the tensioning channel on the outer surface area of the plate cylinder of the printing machine and of being positioned there as accurately as possible.

FIG. 1 shows diagrammatically a partial cross-section through the set-up of a conventional bending machine. Reference symbol 1 is a bending table which is equipped with a bending cheek. On this lies the printing plate 2 to be bent, which is pressed onto the bending table by a holding-down plate 3 in the region of the pressure pad 4. When the printing plate 2 is clamped firmly, the end of the printing plate 2 is bent to form an edge by means of the bending bar 6. This bending operation must take place as exactly as possible for the entire printing plate, since, if the bending edges are not executed exactly on both longitudinal sides of the printing plate, that is to say the edges on the leading and the trailing side of the printing plate, a reduced printing quality is obtained in the case of high printing speeds.

Accordingly, for the present invention, the object arises of providing a bending machine by means of which it is possible to produce bending edges, particularly on a printing plate, with high accuracy.

According to a first aspect of the invention, a bending machine for the bending of a printing-machine printing plate is provided, the bending machine having a bending table, on which the metal sheet or printing-machine printing plate to be processed is deposited for the bending operation. By means of a pressure pad which is fastened to a holding-down plate, the printing plate is fixed to the bending table. Fixing takes place in the immediate vicinity of the bending edge to be produced, before a bending bar bends the metal sheet via a bending cheek having the corresponding angle provided for the metal sheet. The holding-down plate is brought directly up to the metal sheet via a corresponding mechanism, so that a defined clearance is obtained between the pressure pad and the metal sheet to be bent. The pressure pad fastened to the holding-down plate can execute a relative movement with respect to the holding-down plate. By virtue of this relative movement, it is possible to carry out a finely adjusted fixing of the metal sheet on the bending table. This finely adjusted fixing takes place, via the pressure-pad surface, more uniformly than was possible in the prior art, so that the metal sheet is held with a more uniformly distributed force along the bending edge to be produced. A more accurate bending of the metal sheet consequently becomes possible.

According to an advantageous refinement of the invention, a linear drive is provided for executing the relative movement of the pressure pad with respect to the holding-down plate. The linear drive can advantageously introduce as uniformly as possible, over the entire length of the pressure pad, the clamping force which is necessary for fixing the printing plate. This is because, for the idea of the invention, it is essential that as identical a clamping force as possible acts over the entire length of the edge to be bent. Different clamping forces along the bending edge to be produced would also lead to differently pronounced edge portions.

According to an advantageous refinement, the linear drive used is a stretchable hose which preferably consists of silicone and which is filled with a fluid in order to introduce the clamping force. The fluid used may be, for example, compressed air. The hose is arranged between the holding-down plate and the pressure pad and is supported on the holding-down plate, in order to transmit the clamping force, which occurs due to the expansion of the hose, to the metal sheet to be bent. In order to bring about as uniform a force transmission as possible over the entire length of the pressure pad, it is expedient that the hose runs between the holding-down plate and the pressure pad in the longitudinal direction of the pressure pad, that is to say runs in the direction of and along the edge to be bent. However, instead of this arrangement, other geometries may also be used for the run of the hose, insofar as merely the principle of uniform force transmission is implemented. The material used for the hose to be employed is preferably silicone, but all materials allowing sufficient radial expansion may be envisaged.

According to a further refinement according to the invention, a pressure pad is constructed in two parts and consists of a spring element and of a plastic pad. The two-part construction makes it possible for the pressure pad to be fastened to the holding-down plate, without the pressure pad itself having to be capable of being subjected to bending stress. However, it is also conceivable to select the material of the pressure pad such that the latter can be fastened to the holding-down plate and can be pressed away from the holding-down plate by means of the hose.

In the case of a two-part construction, there is provision for the spring element to be a sheet of spring steel which on one longitudinal side, which corresponds to the length of the edge to be bent, is fastened to the holding-down plate, for example by means of screws, and on the other longitudinal side has the plastic pad which is then pressed via the expanding hose against the metal sheet or printing plate to be bent.

Instead of the two-part construction with a spring element, various designs may be envisaged which make it possible for an element acting as a pressure pad to be fastened movably to the holding-down plate, so that a relative movement between the holding-down plate and pressure pad becomes possible.

According to a further refinement of the invention, the hose is provided in a groove of the holding-down plate, so that a defined linear movement in the direction of the metal sheet to be bent becomes possible. The groove is preferably designed with a depth such that, in the state of rest, the hose is accommodated completely in the holding-down plate and the pressure pad comes to bear positively against the holding-down plate. However, this set-up is not mandatory, and it is also conceivable to have a design in which the hose is accommodated in the pressure pad, so that further machining of the holding-down plate no longer becomes necessary. In order to set the defined clearance between the holding-down plate and the metal sheet to be bent, it is advantageous, furthermore, to provide a spacer which may be implemented, for example, by means of a stop screw which makes it possible to set a variable clearance between the holding-down plate and the metal sheet to be bent or the bending table.

BRIEF DESCRIPTION OF THE DRAWINGS

An advantageous embodiment of the invention is explained below with reference to the drawings in which.

DETAILED DESCRIPTION OF THE DRAWINGS

Figure 1:
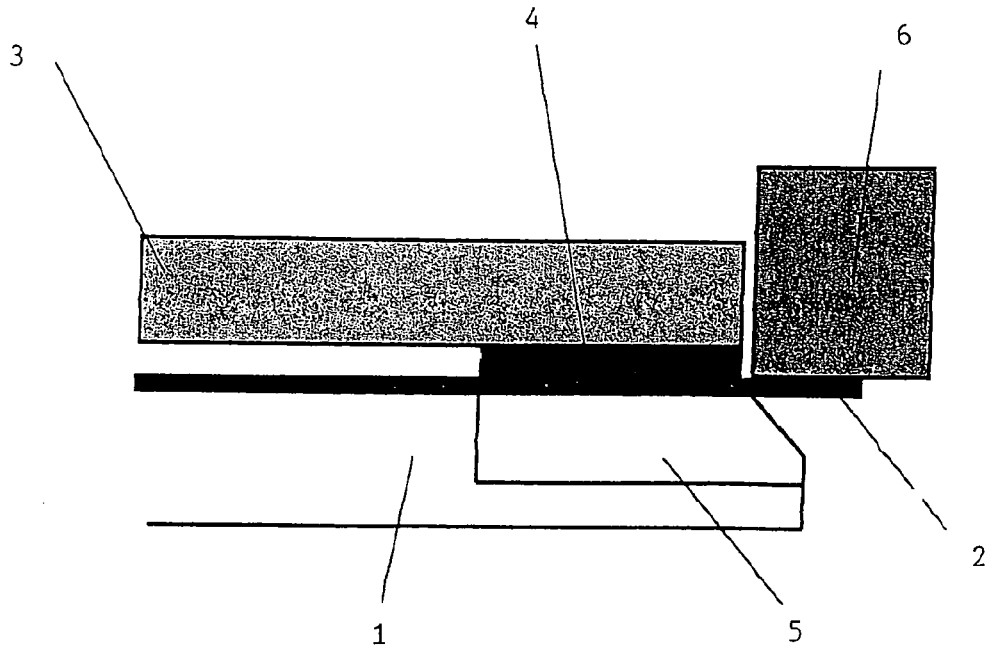
Prior Art Fig. 1
FIG. 1 shows a detail of the bending machine at the bending cheek, such as is known from the prior art.
Figure 2:
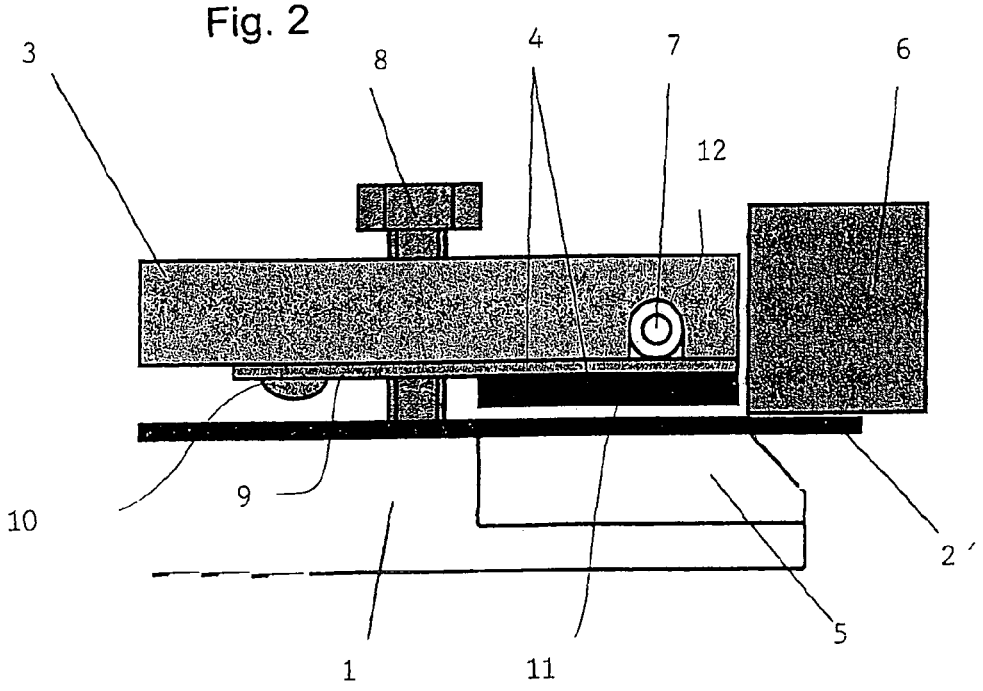
FIG. 2 shows the detail corresponding to FIG. 1 in the case of a bending machine according to the present invention, in the state of rest.

FIG. 2 shows a printing plate 2 which is arranged on a bending table 1 such that the bending edge to be produced is arranged above the bending cheek 5 of the bending table. The holding-down plate 3 is held at a defined clearance with respect to the printing plate 2 by means of the stop screw 8. FIG. 2 shows the embodiment according to the invention in a non-activated state, that is to say the pressure pad 4 still bears against the holding-down plate 3 and does not yet clamp the printing plate 2 on the bending table 1. The pressure pad 4 consists of a sheet-metal rail 9 which is fastened to the holding-down plate 3 by means of screws 10. The sheet-metal rail 9 is produced from spring steel, so that the plastic pad 11, which is fastened to the sheet-metal rail 9, for example, by means of adhesive bonding, is pressed downwards in the groove 12 via the hose 7, as soon as the hose 7 is supplied with compressed air.

Figure 3:
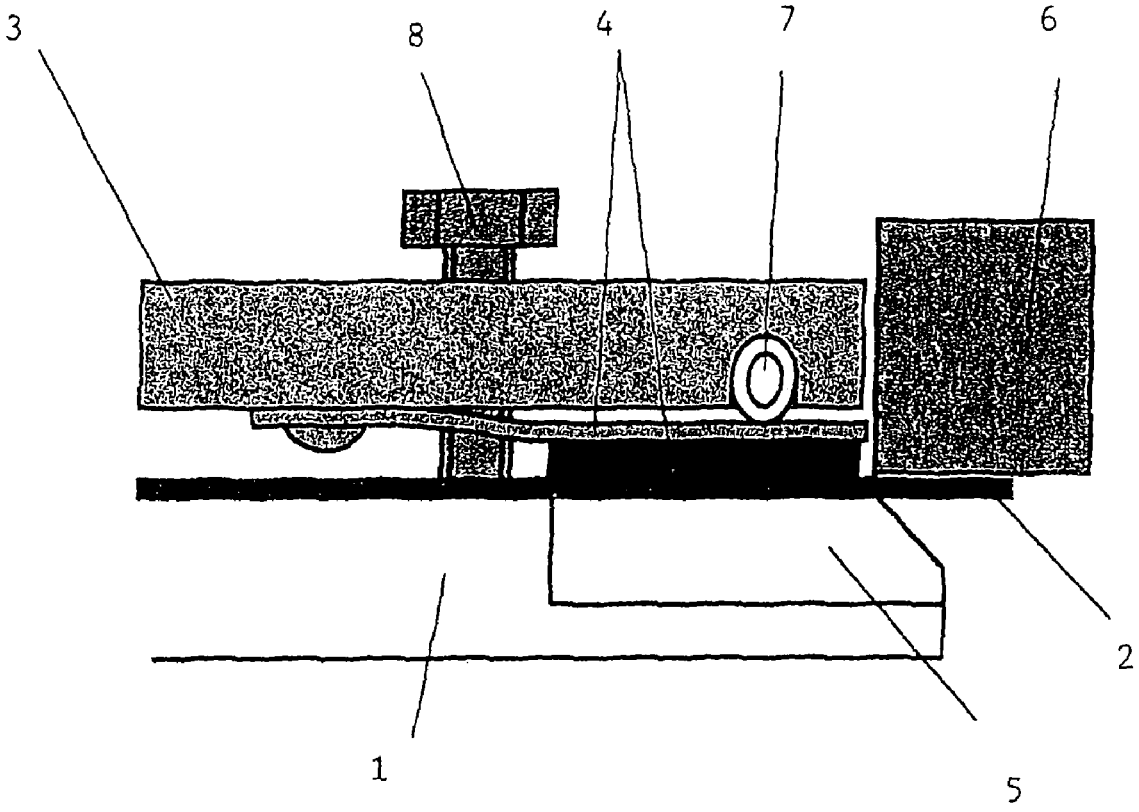
FIG. 3 shows the detail from FIG. 2, the pressure pad clamping the printing plate.

FIG. 3 shows the embodiment according to the invention in the activated state, that is to say the hose 7 then contains compressed air, so that the pressure pad 4, consisting of the sheet-metal rail 9 and plastic pad 11, is pressed onto the bending table and thus clamps the printing plate. Since the hose 7 runs along the entire length of the pressure pad 4 or of the sheet-metal rail 9, a force resulting from the expansion of the hose 7 acts uniformly upon the printing plate. When the printing plate 2 is clamped, the actual bending operation can be initiated by means of the bending bar 6. On account of the uniform holding force exerted by the pressure pad and of the uniform bending force introduced by the bending bar 6, an accurate bending edge is obtained.

List of Reference Symbols:

1. Bending table
2. Printing plate
3. Holding-down plate
4. Pressure pad
5. Bending cheek
6. Bending bar
7. Hose
8. Stop screw
9. Sheet-metal rail
10. Screw
11. Plastic pad
12. Groove The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A bending machine for bending a printing-machine printing plate, comprising a bending table for receiving the printing-machine printing plate, with a bending bar, and with a pressure pad fastened to a holding-down plate for fixing the printing-machine printing plate to the bending table, wherein the pressure pad is relatively moveable with at least one degree of freedom with respect to the holding-down plate and wherein the holding-down plate is held at a defined clearance with respect to the printing plate, wherein to execute a movement of the pressure pad, a linear drive is provided which introduces uniformly, over an entire length of the pressure pad, a clamping force for fixing the printing-machine printing plate on the bending table and wherein the linear drive is a hose which is expandable radially by a fluid and which is arranged between the holding-down plate and the pressure pad and is supported on the holding-down plate for force transmission, wherein an expansion of the hose directly presses the pressure pad against the printing-machine printing plate to provide the clamping force for fixing the printing-machine printing plate on the bending table, wherein the clamping force provided by the expansion of the hose acts uniformly over an entire length of an edge of the printing plate to be bent, and further wherein the pressure pad has a spring steel element and a plastic pad, wherein the spring steel element is fastened on a first longitudinal side to the holding-down plate, and wherein the hose is arranged between a second longitudinal side of the spring steel element and the holding-down plate.

2. The bending machine according to claim 1, wherein the pressure pad is movable perpendicularly with respect to the holding-down plate.

3. The bending machine according to claim 1, wherein the fluid is compressed air and the hose is a silicone hose.

4. The bending machine according to claim 1, wherein the hose is mounted in a groove in the holding-down plate such that a driving direction of the linear drive is defined via the expandability of the hose.

5. The bending machine according to claim 1, wherein a spacer is provided on the holding-down plate which defines the clearance between the holding-down plate and the bending table.

6. An apparatus for bending a printing plate, comprising:

a bending table;

a holding-down plate operable with the bending table;

a pressure pad coupled to the holding-down plate, wherein the pressure pad is relatively moveable with respect to the holding-down plate, wherein the holding-down plate is held at a defined clearance with respect to the printing plate, and wherein the pressure pad includes a spring steel element and a pad fastened to the spring steel element at a first end of the pressure pad; and a drive disposed between the holding-down plate and the pressure pad, wherein the drive is an expandable hose and wherein an expansion of the hose directly presses the pressure pad against the printing plate to provide a clamping force for fixing the printing plate on the bending table and wherein the clamping force provided by the expansion of the hose acts uniformly over an entire length of an edge of the printing plate to be bent.

7. The apparatus according to claim 6, wherein a second end of the pressure pad is fixedly connected to the holding-down plate and wherein the first end of the pressure pad is relatively moveable with respect to the holding-down plate.

8. The apparatus according to claim 6, wherein the hose is disposed in a groove defined by the holding-down plate.

9. A method for bending a printing plate, comprising the steps of:

placing the printing plate on a bending table;

relatively moving a pressure pad with respect to a holding-down plate to clamp the printing plate on the bending table, wherein the holding-down plate is held at a defined clearance with respect to the printing plate and wherein the pressure pad includes a spring steel element and a pad fastened to the spring steel element at a first end of the pressure pad;

wherein the step of relatively moving the pressure pad with respect to the holding-down plate to clamp the printing plate on the bending table includes the steps of expanding a hose disposed between the holding-down plate and the pressure pad to directly press the pressure pad against the printing plate to provide a clamping force for fixing the printing plate on the bending table and wherein the clamping force provided by the expanding of the hose acts uniformly over an entire length of an edge of the printing plate to be bent; and bending the edge of the printing plate.

10. The method according to claim 9, wherein the step of relatively moving the pressure pad with respect to the holding-down plate includes the step of moving the first end of the pressure pad, wherein a second end of the pressure pad is fixedly connected to the holding-down plate.

11. The method according to claim 9, wherein the hose is disposed in a groove defined by the holding-down plate.

* * * * *